US007690290B2

(12) United States Patent
Oehri

(10) Patent No.: US 7,690,290 B2
(45) Date of Patent: Apr. 6, 2010

(54) CARTRIDGE MAGAZINE

(75) Inventor: Kurt Oehri, Schaan (LI)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/820,531

(22) Filed: Jun. 19, 2007

(65) Prior Publication Data

US 2007/0289189 A1 Dec. 20, 2007

(30) Foreign Application Priority Data

Jun. 20, 2006 (DE) ..... 10 2006 000 304

(51) Int. Cl.
*F41A 9/61* (2006.01)
*F41C 3/08* (2006.01)

(52) U.S. Cl. ..... 89/34; 89/33.1; 89/35.01; 102/281; 102/531; 42/57; 42/87; 206/3; 224/223; 224/931

(58) Field of Classification Search ..... 89/33.1, 89/34, 35.01, 33.2; 42/57, 49.01, 87, 88; 102/281, 531; 203/3; 224/223, 931
See application file for complete search history.

(56) References Cited

U.S. PATENT DOCUMENTS

| | | | | |
|---|---|---|---|---|
| 1,488,016 | A * | 3/1924 | McGregor | 206/446 |
| 3,349,710 | A * | 10/1967 | Sposimo | 102/281 |
| 3,625,154 | A | 12/1971 | Gawlick | |
| 3,756,387 | A * | 9/1973 | Chaney | 206/3 |
| 3,927,616 | A * | 12/1975 | Axelrod et al. | 102/464 |
| 4,004,683 | A * | 1/1977 | Pomeroy et al. | 206/3 |
| 4,819,562 | A * | 4/1989 | Bowman | 102/281 |
| 4,920,885 | A * | 5/1990 | Bowman et al. | 102/281 |
| 5,036,746 | A * | 8/1991 | Ehmig et al. | 86/10 |
| D330,670 | S * | 11/1992 | Georgakis et al. | D9/737 |
| 5,208,420 | A * | 5/1993 | Hamilton et al. | 102/281 |
| 5,234,104 | A * | 8/1993 | Schulte et al. | 206/714 |
| 5,279,201 | A * | 1/1994 | Jena et al. | 89/35.01 |
| 5,719,348 | A * | 2/1998 | Bill et al. | 86/38 |
| 5,811,717 | A * | 9/1998 | Day et al. | 89/35.01 |
| 5,897,046 | A * | 4/1999 | Oehri et al. | 227/119 |
| 5,975,399 | A * | 11/1999 | Oehri et al. | 227/120 |
| 6,062,455 | A | 5/2000 | Giannuzzi | |
| 6,116,835 | A * | 9/2000 | Blacket et al. | 411/442 |
| 6,276,253 | B1 * | 8/2001 | Sprenger et al. | 89/35.01 |
| 6,474,212 | B1 * | 11/2002 | Grazioli et al. | 89/35.01 |
| 6,526,891 | B2 * | 3/2003 | Ehmig | 102/467 |
| 6,983,679 | B2 * | 1/2006 | Dittrich et al. | 89/35.01 |

FOREIGN PATENT DOCUMENTS

| | | |
|---|---|---|
| DE | 4444096 | 6/1996 |
| EP | 0560583 | 9/1993 |

* cited by examiner

*Primary Examiner*—Stephen M Johnson
*Assistant Examiner*—Daniel J Troy
(74) *Attorney, Agent, or Firm*—Ableman, Frayne & Schwab

(57) ABSTRACT

A cartridge magazine includes a carrier member (20) having a plurality of receptacles (21) for receiving propellant-containing cartridges (11), longitudinal ribs provided on longitudinal sides of the recess (27) and limiting same; and a cover strip (30) for securing the cartridges in the receptacles and located in the recess (27) formed in a flat surface (23) of the carrier member (20) and extending in a longitudinal direction (L), for limiting the recess, and a cover strip (30) for securing the cartridges in the receptacles and located in the recess (27).

4 Claims, 3 Drawing Sheets

CARTRIDGE MAGAZINE

BACKGROUND OF THE INVENTION

1. Field of the Invention

The present invention relates to a cartridge magazine used, e.g., in powder charge-operated setting tool in which propellant that is contained in a cartridge is used as drive means, and which cartridge magazine includes, a carrier member having a plurality of receptacles for receiving propellant-containing cartridges, a recess formed in a flat surface of the carrier member and extending in a longitudinal direction, and longitudinal ribs provided on longitudinal sides of the recess and which limit the recess.

2. Description of the Prior Art

U.S. Pat. No. 6,062,455 discloses a strip-shaped cartridge magazine formed of a plastic material and in which propellant-containing cartridges are stored. The cartridge magazine has a plurality of equidistantly spaced receptacles in which cartridges are frictionally retained. The receptacles are arranged in nose-shaped, projecting from one side of the magazine strip, elevations. In the receptacles, there are provided, respectively steps that serve as stops for a toric widening of cartridges so that the cartridges are formlockingly retained in the axial direction. Opposite the elevations, there are provided, on longitudinal sides of the carrier strip, bordering ribs with recesses formed therebetween.

The drawback of the cartridge magazine disclosed in U.S. Pat. No. 6,062,455 consists in that cartridges are not frictionally held therein any more upon a position-dependent deformation of the plastic material the magazine is formed of, and can fall out of the receptacles.

German Patent DE-16 782 02 discloses a cartridge magazine with propellants loosely stored in receptacles closed with a separable adhesive strip. The flat sides of the cartridge magazine are completely covered by the strips.

The drawback of the cartridge magazine disclosed in the German patent consists in that it can be displaced only by a special transportation mechanism. When the magazine is displaced by transportation pawls or claws of conventional setting tools an inadvertent detachment of the strip with a pawl or a claw can take place, resulting in a stoppage of the displacement.

Accordingly, an object of the invention is to provide a cartridge magazine that would insure a reliable retention of cartridges in the receptacles, preventing an inadvertent falling out of cartridges from the receptacles.

Another object of the invention is to provide a cartridge magazine that can be displaced without any disturbances.

SUMMARY OF THE INVENTION

These and other objects of the present invention, which will become apparent herein after, are achieved by providing a cartridge magazine in which the cover strip that secures the cartridges in the receptacles, is located in a recess formed in a flat side of the carrier member remote from the walls forming the receptacles. The cover strip secures the cartridges in the axial direction remotely from the open zone of the cartridges and prevents the cartridges from falling out in case of a position-dependent deformation of the carrier member. The arrangement of the cover strip in the recess protects the cover strip from mechanical damages and prevents the strip from inadvertently becoming loose as a result of contact with a transporting element of the setting tool and from causing, as a result, a malfunction in the setting tool such as, e.g., blocking the displacement of the magazine strip. The cover strip can, e.g., be glued on the carrier member or be welded thereto.

Advantageously, the cover strip is formed as a self-adhesive foil which insures an easy mounting of the cover strip on the carrier member. In addition to the bonding of the self-adhesive foil to the carrier member in the recess, it is also bonded or glued to the cartridge bottoms which insure a better retention of the cartridges in the receptacles. Further, the surface of the cover strip or of the self-adhesive foil which is not covered with an adhesive, can be mat or polished, so that the cover strip or foil can be printed on, using a conventional foil printing process.

Advantageously, the cover strip is formed by an adhesive-coated foil formed of a material selected from the group containing polyester and acrylate which are capable to withstand high thermal and mechanical loads.

Advantageously, the recess is limited at a first, in the longitudinal direction, end of the carrier member by a rib that follows a profile of the first end. This reliably protects the cover strip from detachment by a mechanical action when the cartridge magazine is inserted in a setting tool. Alternatively, the cover strip can be spaced from the first end of the carrier member, which also protects the cover strip from an inadvertent detachment.

Advantageously, the cover strip is spaced from a second, in the longitudinal direction, end of the carrier number. Thereby, the cover strip is protected from an inadvertent detachment at this end.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with references to the accompanying drawings.

DETAILED DESCRIPTION OF THE PREFERRED EMBODIMENT

Figure 1:
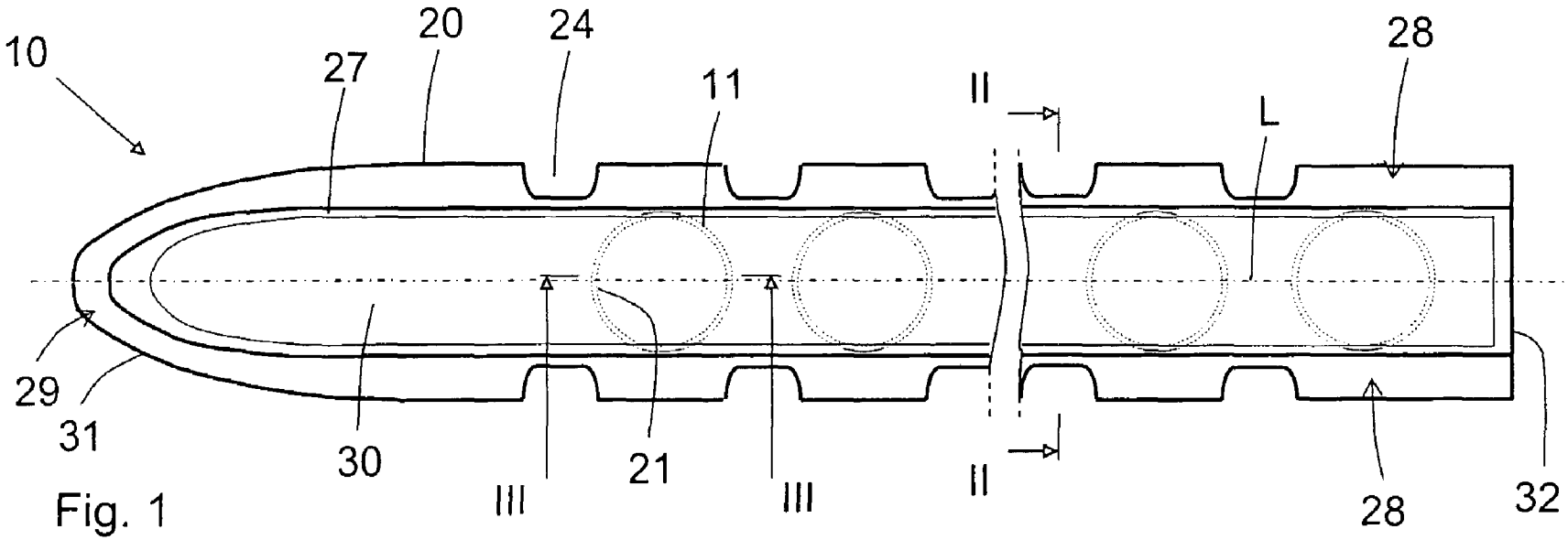
FIG. 1 a plan view of a cartridge magazine according to the present invention.
Figure 2:
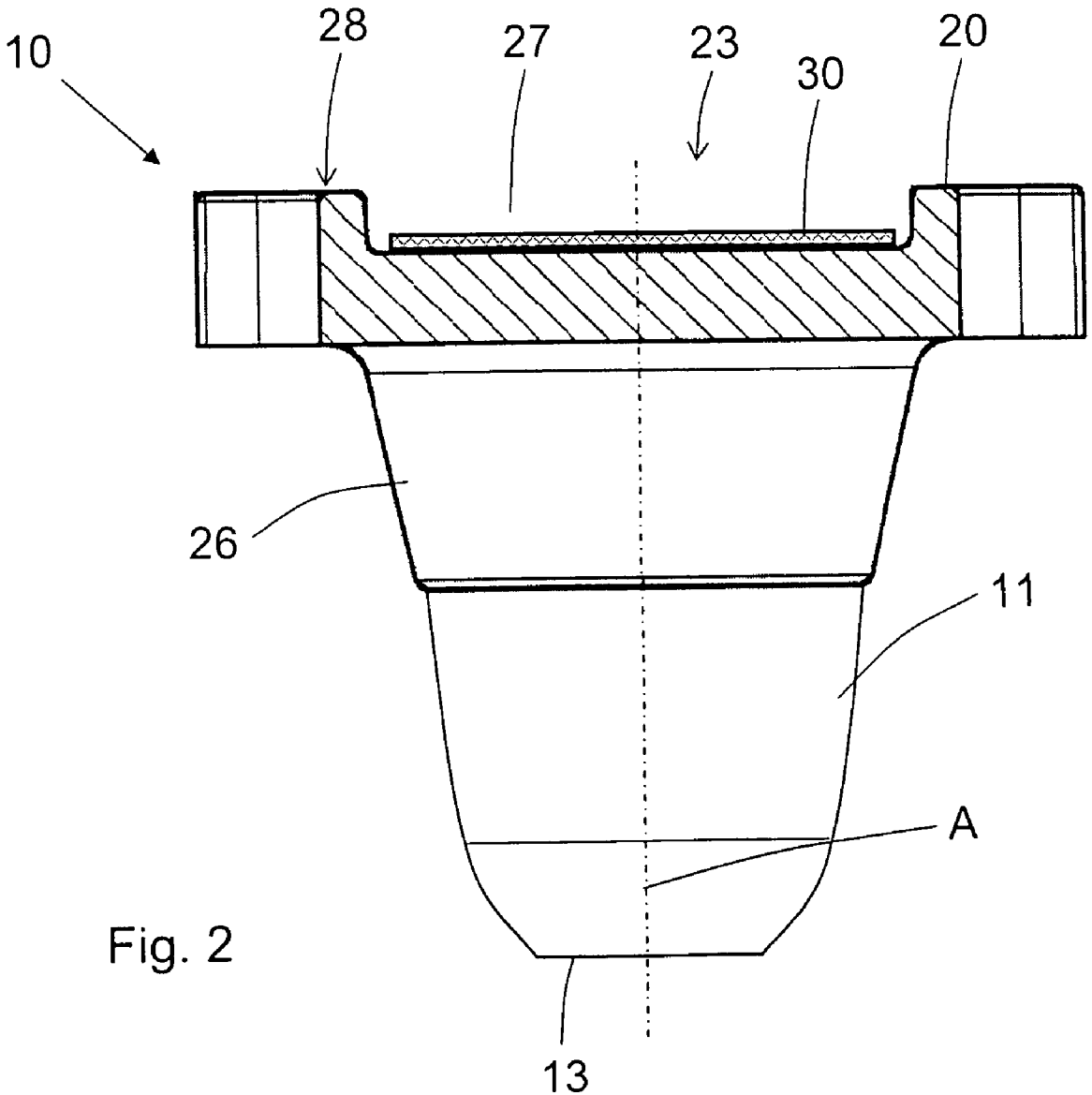
FIG. 2 a cross-sectional view of the cartridge magazine along line II-II in FIG. 1.
Figure 3:
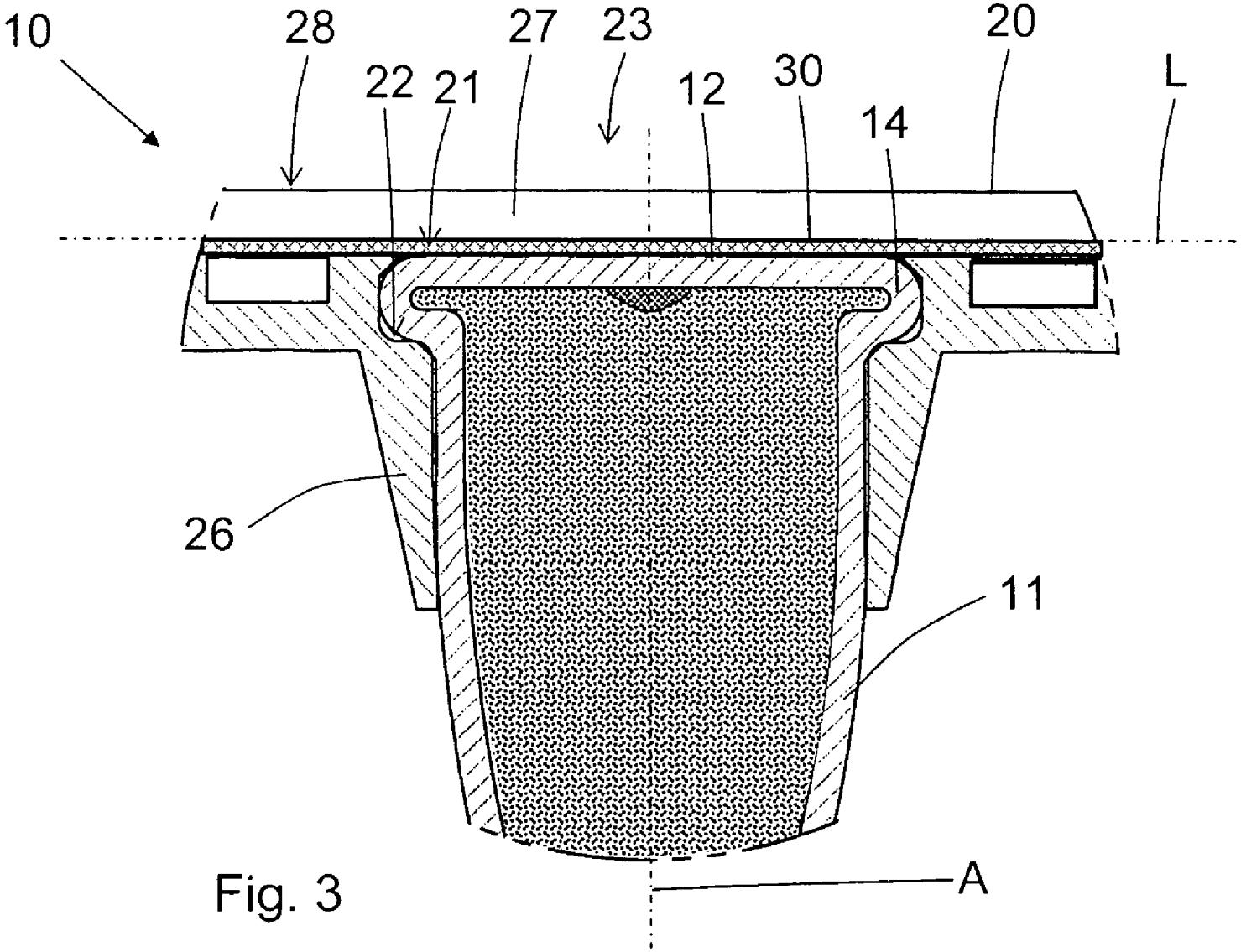
FIG. 3 a cross-sectional view of the cartridge magazine along line III-III in FIG. 1

A strip-shaped cartridge magazine 10 according to the present invention, which is shown in FIGS. 1-3, has a carrier member 20 that extends in a longitudinal direction L and is formed of a plastic material. The carrier member 20 has a plurality of arranged one after another, equidistantly spaced from each other, receptacles 21 for cartridges 11 filled with propellant (FIGS. 2-3). In each receptacle 21, there is provided a step 22 that serves as a stop for a toric widening 14 of a cartridge 11 for formlockingly retain the cartridge 11 in an axial direction defined by a cartridge axis A and an opening zone 13. The cartridge 11 is further frictionally held in the receptacle 11 which is surrounded, at least partially by cylindrical walls 26 that project from the carrier member 20 on one side of the carrier member 20.

On a flat side 23 of the carrier member 20 remote from the walls 26, there is provided a recess 27 extending in the longitudinal direction L of the carrier member 20. The recess 27 limits longitudinal ribs 28 which are formed as bordering elevations and which extend on both longitudinal sides of the carrier member 20 in the longitudinal direction. At a first, in the longitudinal direction L, end 31 of the carrier member 20 which is formed as a conically tapering end, the recess 27 is likewise limited by an approximately parabolic elevation that corresponds in shape to the first end 31 and forms a rib 29 that passes smoothly on both sides of the carrier member 20 into longitudinal ribs 28.

Sidewise on the carrier member 21, there are formed, in the longitudinal ribs 28, transportation recesses 24 into which a transporting element of a setting tool or of a magazine receptacle can engage in order to displace the cartridge magazine 10. The transportation recesses 24 are closed toward the recess 27.

For securing the cartridges 11 in the receptacles 21, there is provided, in the recess 27 in an axial direction remotely from the opening zone 13, a cover strip 30 that is formed as a self adhesive foil. The cover foil 30 is glued to both cartridge bottoms 12 of the cartridges 11 and to the surface of the carrier member 20 located in the recess 27. The cover strip 30 or the self-adhesive foil is formed, e.g., as a polyester or acrylate foil with a high climatic and heat-resistance and which is coated with a special glue such as, e.g., a modified acrylic adhesive or glue that insures a good bonding with low-energy surfaces (such as, e.g., of polypropylene (PP) used as a material of the carrier member 20) without lubrication or slightly lubricated.

With the cover strip 30 being arranged in the recess 27, the strip 30 is protected from a mechanical damage, and is prevented from inadvertently becoming loose as a result of contact with the transporting element or the like, and from causing a malfunction in the setting tool, e.g., blocking the displacement of the magazine strip.

At the second, in the longitudinal direction L, end 32 of the carrier member 20 where no bordering elevation is available, the cover strip does not extend completely to the second end 32. This can also take place at the first end 31 when, e.g., no rib should be provided there.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A cartridge magazine for propellant charge-operated setting tools, comprising:

a carrier member (20) having:

a plurality of receptacles (21) for receiving propellant-containing cartridges (11), a recess (27) formed in a flat surface (23) of the carrier member (20) and extending in a longitudinal direction (L), and longitudinal ribs provided on longitudinal sides of the recess (27) and limiting same; and a cover strip (30) for securing the cartridges in the receptacles and located in the recess (27);

wherein the recess (27) is limited at a first end (31) of the carrier member (20), in the longitudinal direction, by a rib (29) that follows a profile of the first end (31).

2. A cartridge magazine according to claim 1, wherein the cover strip is formed as a self-adhesive foil.

3. A cartridge magazine according to claim 1, wherein the cover strip (30) is formed by an adhesive-coated foil formed of a material selected from the group containing polyester and acrylate.

4. A cartridge magazine according to claim 1, wherein the cover strip (30) is spaced from a second end (32) of the carrier member (20) in the longitudinal direction (L).

* * * * *